US007186077B2

(12) United States Patent
Daudel et al.

(10) Patent No.: US 7,186,077 B2
(45) Date of Patent: Mar. 6, 2007

(54) COMPRESSOR, PARTICULARLY IN AN EXHAUST GAS TURBOCHARGER FOR AN INTERNAL COMBUSTION ENGINE

(75) Inventors: Helmut Daudel, Schorndorf (DE); Paul Löffler, Stuttgart (DE); Stephan Schenkel, Stuttgart (DE); Joseph Spurk, Bad König (DE)

(73) Assignee: DaimlerChrysler A G, Stuttgart (DE)

( * ) Notice: Subject to any disclaimer, the term of this patent is extended or adjusted under 35 U.S.C. 154(b) by 234 days.

(21) Appl. No.: 11/064,417

(22) Filed: Feb. 23, 2005

(65) Prior Publication Data

US 2005/0207885 A1 Sep. 22, 2005

Related U.S. Application Data

(63) Continuation-in-part of application No. PCT/EP03/08741, filed on Aug. 7, 2003.

(30) Foreign Application Priority Data

Aug. 23, 2002 (DE) ..... 102 38 658

(51) Int. Cl.
*F01D 17/16* (2006.01)

(52) U.S. Cl. ..... 415/164; 415/165; 415/186; 415/191

(58) Field of Classification Search ..... 415/163–165, 415/186, 191; 417/407
See application file for complete search history.

(56) References Cited

U.S. PATENT DOCUMENTS

| | | | | |
|---|---|---|---|---|
| 3,992,128 | A | 11/1976 | Lunsford et al. | |
| 4,325,673 | A * | 4/1982 | Hall, Jr. | 415/113 |
| 4,403,913 | A | 9/1983 | Fisker | |
| 4,657,476 | A | 4/1987 | Berg | |
| 4,780,049 | A * | 10/1988 | Palmer et al. | 415/36 |
| 5,207,559 | A | 5/1993 | Clevenger et al. | |

FOREIGN PATENT DOCUMENTS

| | | |
|---|---|---|
| DE | 1 211 746 | 3/1966 |
| DE | 24 42 896 | 3/1976 |
| FR | 2 599 436 | 12/1987 |

* cited by examiner

*Primary Examiner*—Ninh H. Nguyen
(74) *Attorney, Agent, or Firm*—K. Bach

(57) ABSTRACT

In a compressor particularly of an exhaust gas turbocharger of an internal combustion engine having a compressor wheel rotatably supported in a compressor housing which includes a diffuser structure with an adjustable diffuser geometry comprising guide vanes pivotally supported, an adjustment ring is provided with engagement elements which engage forked end structures of the guide vanes at the outer ends of the guide vanes opposite the pivotal guide vane support so that the pivot position of the guide vanes can be adjusted by rotation of the adjustment ring.

8 Claims, 2 Drawing Sheets

COMPRESSOR, PARTICULARLY IN AN EXHAUST GAS TURBOCHARGER FOR AN INTERNAL COMBUSTION ENGINE

This is a Continuation-In-Part Application of International Application PCT/EP03/08741 filed Aug. 7, 2003 and claiming the priority of German application 102 38 658.7 filed Aug. 23, 2002.

BACKGROUND OF THE INVENTION

The invention relates to a compressor, particularly in an exhaust gas turbocharger, for an internal combustion engine with a compressor wheel rotatably supported in a compressor housing and a diffuser which is arranged in the compressor housing upstream of the compressor wheel and has a variable diffuser geometry formed by adjustable guide vanes.

In such a compressor as described for example in U.S. Pat. No. 5,207,559, fresh air is supplied to the compressor by way of a compressor supply channel and is compressed by a compressor wheel in the compressor housing and is then conducted downstream of the compressor wheel through a diffuser. The compressor wheel is driven via a shaft by a turbine with a turbine wheel to which gas under pressure is supplied.

In order to increase the operating range of the compressor which is limited on one hand in the area of small mass flows by the pumping limit and, on the other hand, in the area of large mass flows by the blocking limit, the compressor has a variably adjustable diffuser geometry which permits to change the geometry of the diffuser downstream of the compressor wheel depending on the momentary operating point of the compressor. The diffuser geometry comprises guide vanes which are distributed over the circumference of the diffuser and are pivotally supported so as to be adjustable and a rotatable adjustment ring is provided with adjustment members engaging the guide vanes for pivoting the guide vanes about their pivot axes so as to adapt the guide vane positions to various flow conditions in the diffuser.

The adjustment movement of the adjustment ring is transferred by the adjustment members to the guide vanes which are supported in the housing. The adjustment members are rotatably supported by the adjustment ring and bridge a radial gap between the adjustment ring and the guide vane pivot shafts. Because of the pivotal support of the guide vanes shafts in the housing and the distance between the guide vane shafts and the support shafts of the adjustment members, the adjustment ring can be pivoted only to a limited degree. Large adjustment movements cannot be accomplished with this adjustment arrangement and an accurate adjustment of the guide vane positions cannot be ensured.

It is the object of the present invention to provide such a compressor with a variably adjustable diffuser geometry which is simple in design and accurately adjustable. It should also be safe from jamming and from distortions and operable with relatively small adjustment forces.

SUMMARY OF THE INVENTION

In a compressor particularly of an exhaust gas turbocharger of an internal combustion engine having a compressor wheel rotatably supported in a compressor housing which includes a diffuser structure with an adjustable diffuser geometry comprising guide vanes pivotally supported, an adjustment ring is provided with engagement elements which engage forked end structures of the guide vanes at the outer ends of the guide vanes opposite the pivotal guide vane support so that the pivot position of the guide vanes can be adjusted by rotation of the adjustment ring.

In this way, the adjustment force for changing the pivot position of the guide vanes is not applied to the guide vane pivot shaft, but is directly transmitted to the guide vanes at a distance from the guide vane pivot shaft whereby smaller and more accurately controllable adjustment forces are required for the adjustment of the guide vanes. Expediently, the guide vanes which are annularly uniformly distributed around the compressor wheel are engaged by adjustment elements particularly at their radially outer ends which are disposed at a larger distance from the center of the diffuser geometry than the guide vane shafts. In this embodiment, the guide vanes are advantageously supported on a bearing ring, particularly they are engaged by the bearing ring only at one side thereof. With such an engagement of the guide vanes only at one side of the compressor diffuser in the compressor wheel discharge area, the possibility of jamming of the guide vanes is eliminated which, with a double-sided support on the opposite diffuser walls could possibly occur because of the substantial temperature differences between the diffuser walls.

Another advantage of the arrangement according to the invention resides in the simple design and in the small number of building components required, particularly the relatively small number of movable parts. As a result, undesired leakages, particularly in the area of the support shaft penetrations are reduced and the efficiency of the compressor is improved.

In accordance with a preferred embodiment of the invention, the guide vanes are fork-like shaped at their ends remote from the guide vane shafts so that they have two spaced tines between which the adjustment element of the adjustment ring extends. The adjustment element is preferably an adjustment pin which is firmly mounted to the adjustment ring and which, with a rotation of the adjustment ring, adjusts the pivot position of the guide vanes, all by the same angle as desired. This simple arrangement has been found to operate with high reliability.

By a rotation of the adjustment ring, the guide vanes are pivoted about the guide vane shaft by the desired angle wherein, with a co-axial arrangement of the adjustment ring and the compressor wheel, the distance of the adjustment elements from the compressor wheel remains constant during the adjustment movement of the adjustment ring.

Expediently, the diffuser geometry, which comprises the pivotable guide vanes, is supported directly on a back wall of the compressor housing which also delimits the front side of the compressor wheel. Furthermore, the diffuser geometry may comprise a support ring on which the guide vane shafts are supported and which is firmly connected to the housing, particularly the rear wall of the compressor housing. At the front side of the support ring, there are, also expediently uniformly distributed in an annular pattern, a plurality of guide vanes whose guide vane shafts are rotatably supported on the support, ring. Each guide vane is operated by an associated adjustment element of the adjustment ring, wherein the adjustment elements on the adjustment ring extend over the support ring at the radially outer end thereof. The support ring is arranged preferably between the guide vanes and the adjustment ring, wherein, preferably, the support ring is rotatably received in the adjustment ring. This can be realized in that the radially outer end of the support ring is supported rotatably at the radially inner end of the adjustment ring. Alternately, the support ring may be provided with axially projecting support elements which are supported rotatably at the radially inner end of the adjustment ring.

The rotational movement of the adjustment ring about the adjustment ring axis for adjusting the guide vanes between the guide vane end positions is accomplished expediently via a push/pull rod which is connected to the adjustment ring and which is operated by an actuator.

The invention will become more readily apparent from the following description thereof on the basis of the accompanying drawings.

DESCRIPTION OF A PREFERRED EMBODIMENT

Figure 1:
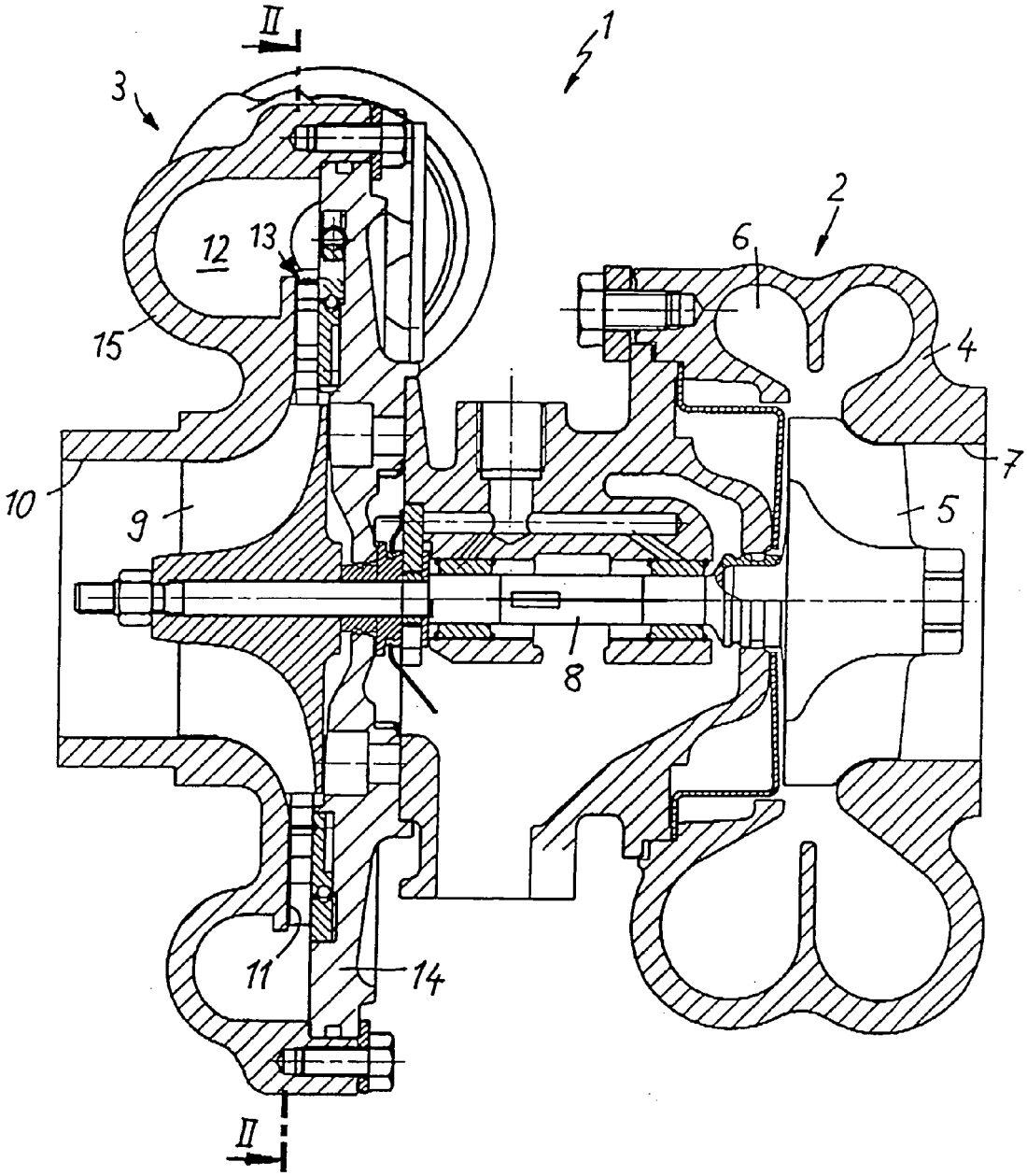
FIG. 1 is a cross-sectional view of an exhaust gas turbocharger including a compressor and an exhaust gas turbine, wherein the compressor includes in the compressor wheel exit area a diffuser with an adjustable guide vane structure.

FIG. 1 shows an exhaust gas turbocharger 1 as it is expediently used in connection with internal combustion engines. It comprises an exhaust gas turbine 2, which is arranged in the exhaust duct of the internal combustion engine and a compressor 3, which is disposed in the intake duct of the internal combustion engine. The exhaust gas turbine 2 includes a turbine housing 4, and a turbine wheel 5, which is driven by the exhaust gases of the internal combustion engine and to which the exhaust gas discharged from the internal combustion engine under pressure is supplied via a spiral inlet passage 6. The exhaust gas is discharged from the exhaust gas turbine 2 axially via a discharge duct 7. The rotational movement of the turbine wheel is transmitted, via a shaft 8, to a compressor wheel 9 in the compressor housing 15. By the rotation of the compressor wheel 9 combustion air supplied by way of an inlet passage 10 is compressed to an increased charge pressure, at which pressure the combustion air leaves the compressor via a radial diffuser 11. The diffuser 11 leads to a spiral discharge channel 12 from which the compressed combustion air is supplied via an engine intake duct to the cylinders of the internal combustion engine.

The diffuser 11 is in the form of a radial annular exit channel between the radial exit passage of the compressor wheel 9 and the spiral discharge channel 12 and includes an adjustable diffuser geometry or guide vane structure 13, by way of which the effective flow cross-section of the diffuser 11 can be adjusted depending on the operating conditions of the internal combustion engine or the drive components connected to the internal combustion engine. The flow cross-section of the diffuser is changed by the adjustment of the diffuser geometry particularly by an increase of the operating range of the compressor. It is possible in this way to stabilize the compressor operation near the limits of the acceptable compressor operating range close to the blocking limit and also close to the pumping limit so that the pumping limit and consequently compressor pumping conditions can safely be avoided.

In the exemplary embodiment, the diffuser geometry can be adjusted by adjustable guide vanes which are arranged in the diffuser flow cross-section. The diffuser geometry may also be adjusted by an axial displacement of the diffuser side walls. In the embodiment shown herein, a compressor back wall forms one of the side walls of the diffuser 11, wherein the compressor back walls 14 delimits the axial front side of the compressor wheel 9 as well as the variable diffuser geometry 13.

The variable diffuser geometry 13 may be a pre-assembled module which is installed into the diffuser 11.

The exhaust gas turbine 2 may also be provided with a variably adjustable flow geometry (inlet vane structure) by way of which the effective turbine inlet flow cross-section is adjustable.

Figure 2:
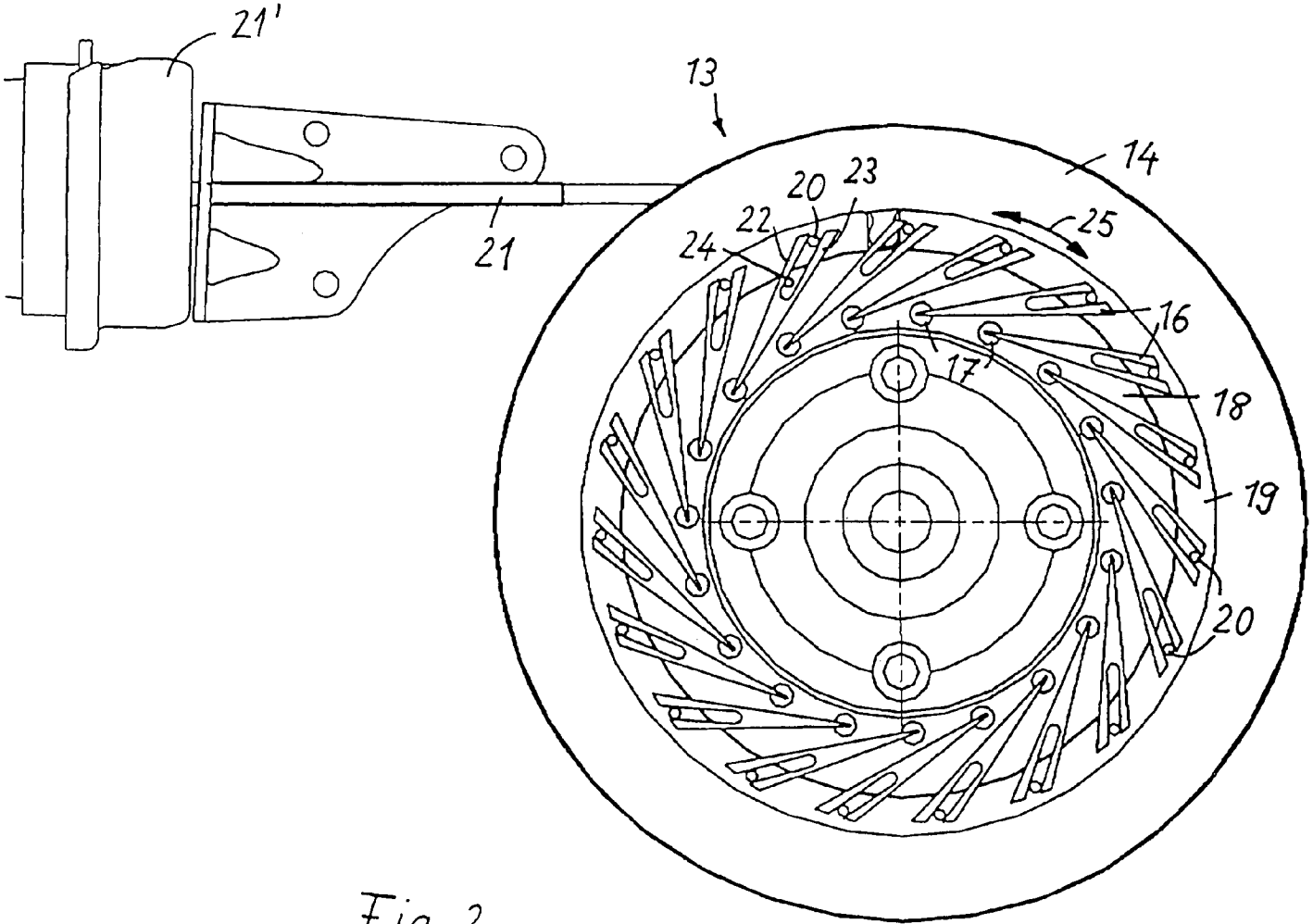
FIG. 2 is a cross-sectional view taken along line II—II of FIG. 1 showing the variable diffuser geometry and an actuating device for operating the diffuser geometry.

FIG. 2 shows the variable diffuser geometry 13 on the rear compressor wall 14. The variable diffuser geometry 13 comprises a plurality of annularly arranged guide vanes 16 which are uniformly distributed over the circumference and each of which includes a guide vane shaft 17 by which it is rotatably supported. The guide vane shaft 17 of each guide vane 16 is pivotally supported in a support ring 18, which is mounted to the housing, specifically to the rear compressor wall 14 so as to be firmly connected thereto. The support ring 18 is surrounded by an adjustment ring 19, which is arranged co-axially with the support ring 19. The radially inner end of the adjustment ring 19 is rotatably supported on the radially outer circumference of the support ring 18. The adjustment ring 19 includes a plurality of adjustment elements 20 in the form of pins arranged at an axial front side of the adjustment ring 19, wherein always one adjustment element 20 is associated with one guide vane 16 of the support ring 18. The adjustment ring 19 is engaged by an adjustment member 21 in the form of an operating rod for rotating the adjustment ring 19. The adjustment member 21 is operated by an actuator 21'. The adjustment member 21 is capable of rotating the adjustment ring 19, whereby the adjustment elements 20 on the adjustment ring 19 are moved circumferentially by a certain angle whereby the guide vanes 16 on the support ring 18 are pivoted all by a corresponding angle about their guide vane shaft 17. With the pivot movement of the guide vanes 16, the open flow cross-section between adjacent guide vanes is changed whereby also the pressure ratio between the compressor inlet side and the compressor outlet side is changed and particularly the operation of the compressor near the pumping limit can be influenced. The guide vane shafts 17 of the guide vanes 16 have a smaller distance from the center of the support ring 18 or, respectively, the axis of the adjustment ring 19 than the adjustment elements 20 on the adjustment ring 19 so that only a relatively small force in the circumferential direction of the adjustment ring 19 is needed for the pivotal adjustment of the guide vanes about the guide vane shafts.

Each guide vane 16 is fork-like shaped with two spaced fork tines 22 and 23 disposed at their outer ends between which a radially outwardly open engagement channel is formed into which the adjustment element 20 extends in any position of the adjustment ring 19. In this way, it is ensured that, during an adjustment movement of the adjustment ring 19 in the direction of the arrow 25, the guide vanes 16 are firmly guided in any position of the adjustment ring 19.

The adjustment can be supported by the support ring 18 in an alternative embodiment also in such a way that support elements which are connected to the support ring and project axially from the support ring abut the radially inner end of the adjustment ring which thereby is rotatably supported on the support ring 18.

The variable diffuser provides for a control arrangement for the air mass flow to the engine or, respectively, the air ratio $\lambda$ which, with the free adjustability of the guide vanes, is accurately adjustable depending on the individual control requirements for the air flow to be supplied to the engine. In this way, particle flow regeneration of for example a Diesel engine can be supported by a short reduction of the air ratio λ and a resulting increase in the engine exhaust gas temperatures. Furthermore, a catalytic converter operating temperature can be adjusted depending on individual requirements. Furthermore, at engine start up, the engine startup period or the engine exhaust temperature can be increased for a reduction of the engine emissions and increasing the catalytic converter operating temperature. By increasing the engine temperature in certain engine operating ranges, with the use of an SCR system, also the conversion rate can be increased. The variable diffuser permits furthermore a reduction of the exhaust gas turbocharger speed in connection with the use of a larger compressor without a deterioration of the pumping limit of the compressor.

What is claimed is:

1. A compressor particularly in an exhaust gas turbocharger for an internal combustion engine, comprising a compressor housing (15), a compressor wheel (9) rotatably supported in the compressor housing (15), a diffuser structure formed by the compressor housing (15) downstream of the compressor wheel and including an adjustable diffuser geometry (13) comprising adjustable guide vanes (16) with guide vane shafts (17) for pivotally supporting the guide vanes, an adjustment ring (19) rotatably supported in the turbine housing (15) and having engagement elements (20) for engaging the guide vanes (16), the guide vanes (16) having at their ends remote from the guide vane shafts (17) a fork-structure with two-spaced fork tines (22, 23) between which the engagement elements (20) of the adjustment ring (19) are received for pivoting the guide vanes (16) about the guide vane shafts (17) upon rotation of the adjustment ring (19).

2. A compressor according to claim 1, wherein the compressor housing (15) includes a rear compressor wall (14) and the diffuser geometry (13) is supported on the rear compressor wall (14) adjacent the downstream end of the compressor wheel (9).

3. A compressor according to claim 1, wherein the guide vane shafts (17) are supported at one side thereof by a support ring (18).

4. A compressor according to claim 3, wherein the support ring (18) is disposed radially within the adjustment ring (19) which is rotatable for adjusting the pivot position of the guide vanes (16).

5. A compressor according to claim 3, wherein the adjustment elements (23) of the adjustment ring (19) extend over the support ring (18) at the radially outer end thereof.

6. A compressor according to claim 5, wherein the outer edge of the support ring is received in the adjustment ring (19) and is supported by the adjustment ring (19) so as to be rotatable therein.

7. A compressor according to claim 5, wherein the support ring (18) includes axially projecting support elements by way of which it is rotatably supported on the inner radial circumference of the adjustment ring (19).

8. A compressor according to claim 3, wherein the adjustment ring (19) is rotatably supported on the support ring (18).

* * * * *